US006260585B1

(12) United States Patent
Speich

(10) Patent No.: US 6,260,585 B1
(45) Date of Patent: Jul. 17, 2001

(54) HARNESS CORD ARRANGEMENT FOR A JACQUARD LOOM

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/463,689

(22) PCT Filed: May 27, 1998

(86) PCT No.: PCT/CH98/00222

§ 371 Date: Jan. 28, 2000

§ 102(e) Date: Jan. 28, 2000

(87) PCT Pub. No.: WO99/06620

PCT Pub. Date: Feb. 11, 1999

(30) Foreign Application Priority Data

Jul. 22, 1997 (DE) ..... 197 31 447

(51) Int. Cl.[7] ..... D03C 3/42; D03C 3/38
(52) U.S. Cl. ..... 139/85
(58) Field of Search ..... 139/85, 86

(56) References Cited

U.S. PATENT DOCUMENTS 770,258 * 9/1904 Brown et al. ..... 139/85
2,795,242 * 6/1957 Houk et al. ..... 139/85
3,724,512 4/1973 Kohl .
5,608,961 * 3/1997 Piegeler ..... 139/85
5,636,663 * 6/1997 Lacroix ..... 139/85

FOREIGN PATENT DOCUMENTS 123669C 9/1901 (DE) .
143464C 8/1903 (DE) .
4031515 10/1991 (DE) .
2971299 9/1997 (DE) .
0709503 5/1996 (EP) .

* cited by examiner

*Primary Examiner*—Andy Falik
(74) *Attorney, Agent, or Firm*—Sidley Austin Brown & Wood, LLP

(57) ABSTRACT

A loom harness having upper and lower hardness board, a plurality of harness cords jointly guided for each pattern repetition in the passage holes of the upper harness board and individually guided in the second passage holes of the lower harness board, a row of an arrangement of the harness cords in the upper harness board being applied, in the weft direction, in an identical sequence in harness pattern repetitions in the lower harness board, and with harness cords, which are guided in a passage hole in the upper harness board, being crossed by at least one cord of the harness cord sections guided through an adjacent passage hole in the upper harness board.

8 Claims, 9 Drawing Sheets

HARNESS CORD ARRANGEMENT FOR A JACQUARD LOOM

BACKGROUND OF THE INVENTION

1. Field of the Invention

The present invention relates to a loom harness having upper and lower harness boards which have passage holes arranged in a grid, a plurality of harness cords which are jointly guided for each pattern repetition in the passage holes of the upper harness board and individually in the passage holes of the lower harness board, a plurality of snap hooks for connecting the harness cords to the Jacquard device, and a plurality of return motion elements and heddles which are, in each case, connected to the harness cords, with a row of the arrangement of the harness cords in the upper harness board being mapped in the identical sequence in the harness pattern repetitions in the lower harness board in the weft direction.

2. Description of the Prior Art

A Jacquard loom consists in general of a Jacquard device, a loom harness and a loom. The Jacquard device contains shed forming elements with a lifter which is connected to the loom harness.

FIGS. 1 and 2 show a known embodiment of a loom harness and a Jacquard device. The loom harness is assembled from bottom to top or from top to bottom respectively and is thus divided into a lower part and an upper part. The lower part comprises return motion elements and heddles. The upper part comprises snap hooks, harness cords and an upper and lower harness board with passage holes. The harness cords per pattern repeat are connected to the strap and are arranged together in a passage hole in the upper harness board and individually in passage holes in the lower harness board. The harness cords can be designed as single or double cords which are in each case provided with a loop and are hung in into the snap hook with this loop.

In the known loom harness all harness cords of a through-bore in the upper harness board are mapped completely identically in all pattern repeats in the lower harness board. The harness cords of the following passage bores in the upper harness boards are successively arranged in the same manner. When all harness cords are arranged, then these mutually cross hole-wise as is illustrated in FIG. 2. At the locations designated with "X" in Fig., a pressure is exerted on the harness cords and a strong friction is produced. This arrangement of the harness cords has the disadvantages that during operation the harness cords oscillate and/or are highly stressed against one another and at the edge of the through-bore by the friction. Through this the lifetime and the working speed of the loom harness is restricted to a high degree.

The object of the invention is to improve a loom harness in such a manner that the named disadvantages are eliminated and a considerable increase of the working speed of the loom is made possible.

SUMMARY OF THE INVENTION

The object of the invention is achieved by crossing through the sections of the harness cord, which are guided in a passage hole in the upper harness board, by at least one cord of the sections which are guided through the adjacent bore in the upper harness board.

BRIEF DESCRIPTION OF THE DRAWINGS

The invention will be described in the following with reference to the accompanying drawings.

The drawings show.

DETAILED DESCRIPTION OF THE PREFERRED EMBODIMENT

Figure 1:
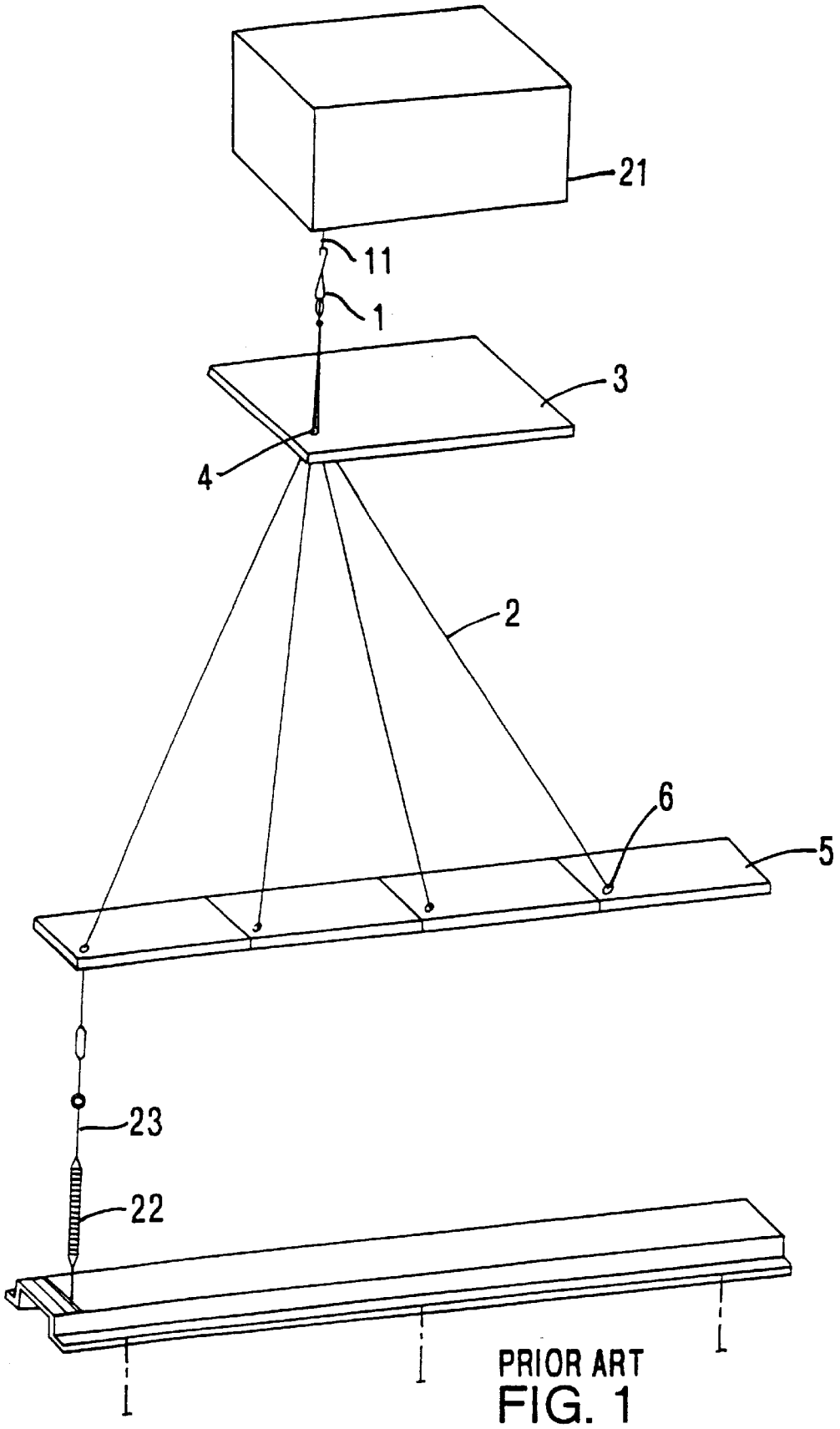
PRIOR ART FIG. 1
FIG. 1 a known embodiment of a loom harness.

As it has already been discussed above, the upper part of a conventional loom harness, which is shown in FIG. 1, contains a plurality of snap hooks 1 and harness cords 2 as well as an upper harness board 3 with passage holes 4 and a lower harness board 5 with passage holes 6. The arrangement of the hole rows in the upper and lower harness board is known. A plurality of return motion elements (springs 2) and heddles 23 (only one return motion elements and one heddles are shown in FIG. 1) are connected to harness cords 21, respectively.

Figure 3:
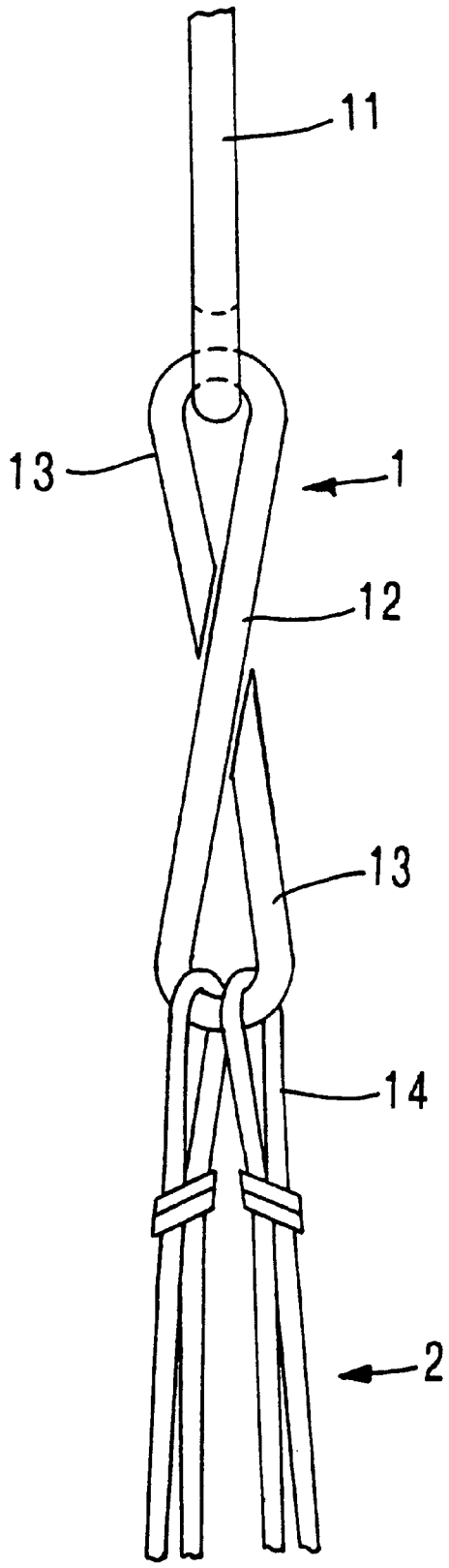

As FIG. 3 shows, a snap hook 1 is provided for connection of a board 11 of the Jacquard device 22 to the loom harness and is designed in a single piece. The snap hook has a middle section 12 and two sections which are designed as eyes 13 and which are elastically deformable in order to be able to open the eyes. The connection location of the board 11 to the upper eye of the snap hook forms the harness separation point. The harness cords 2 are designed as double cords with a loop 14 at one end and two sections which are in each case connected to heddles of the lower part of the loom harness.

Figure 4:
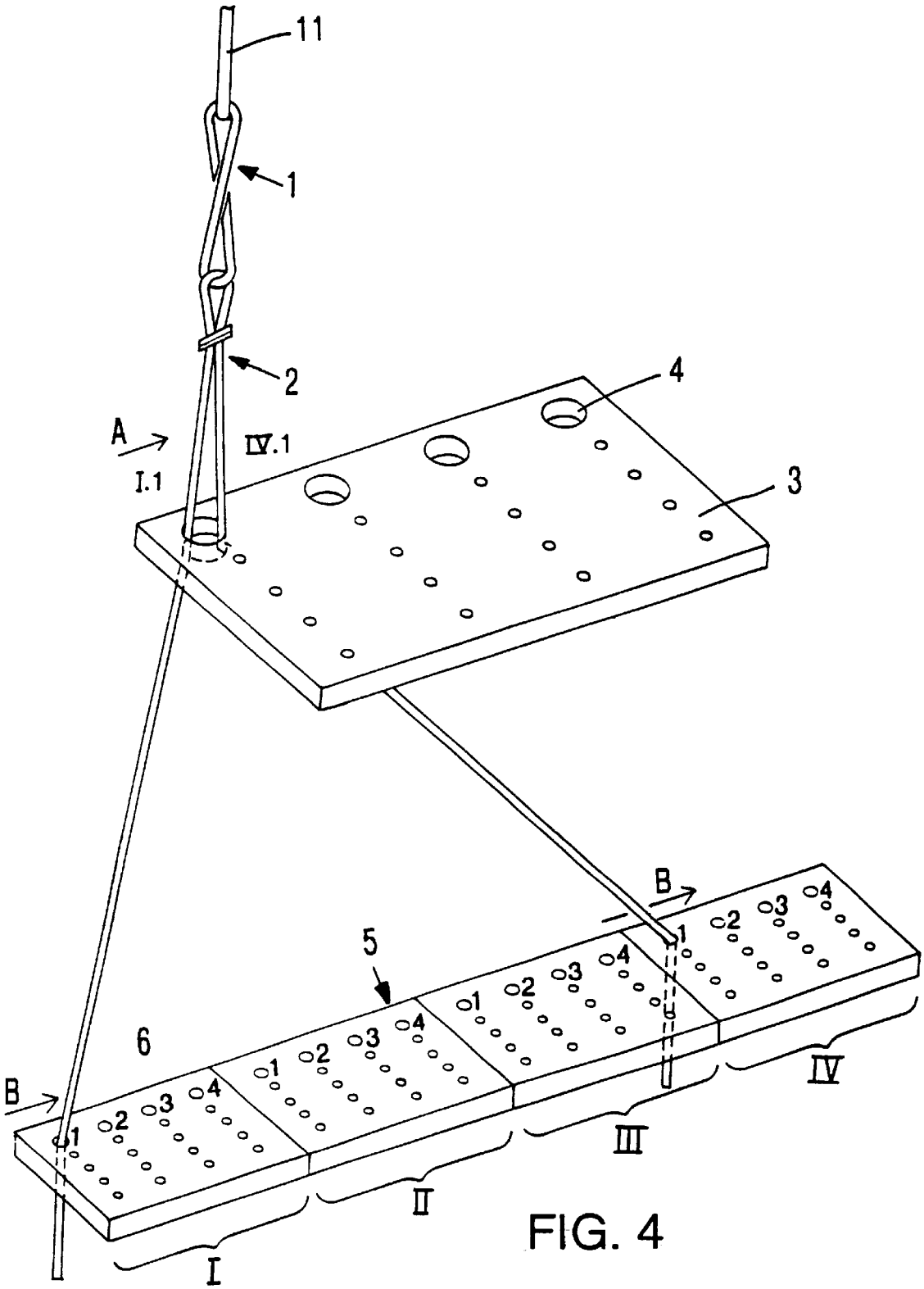

For a better understanding an embodiment of a loom harness in accordance with the invention will be explained with reference to a step-wise build up and with reference to FIGS. 4 to 9, with the harness cords being arranged in rows from the rear left to right (weft direction; arrows A and B respectively) and from back to front (warp direction; arrows C and D respectively) as seen from the standing position of the weaver. Reference is made to FIG. 4. The loom harness has four pattern repetitions I to IV. Only one harness cord 2 is arranged. For a better understanding the sections of the harness cord will be designated in the following in accordance with the pattern repetitions I to IV. The sections I.1 and IV.1 of the double cord are led in common through the left passage hole in the upper harness board 3 and in each case individually through the left passage holes of the outwardly lying pattern repetitions I and IV in the lower harness board.

Figure 5:
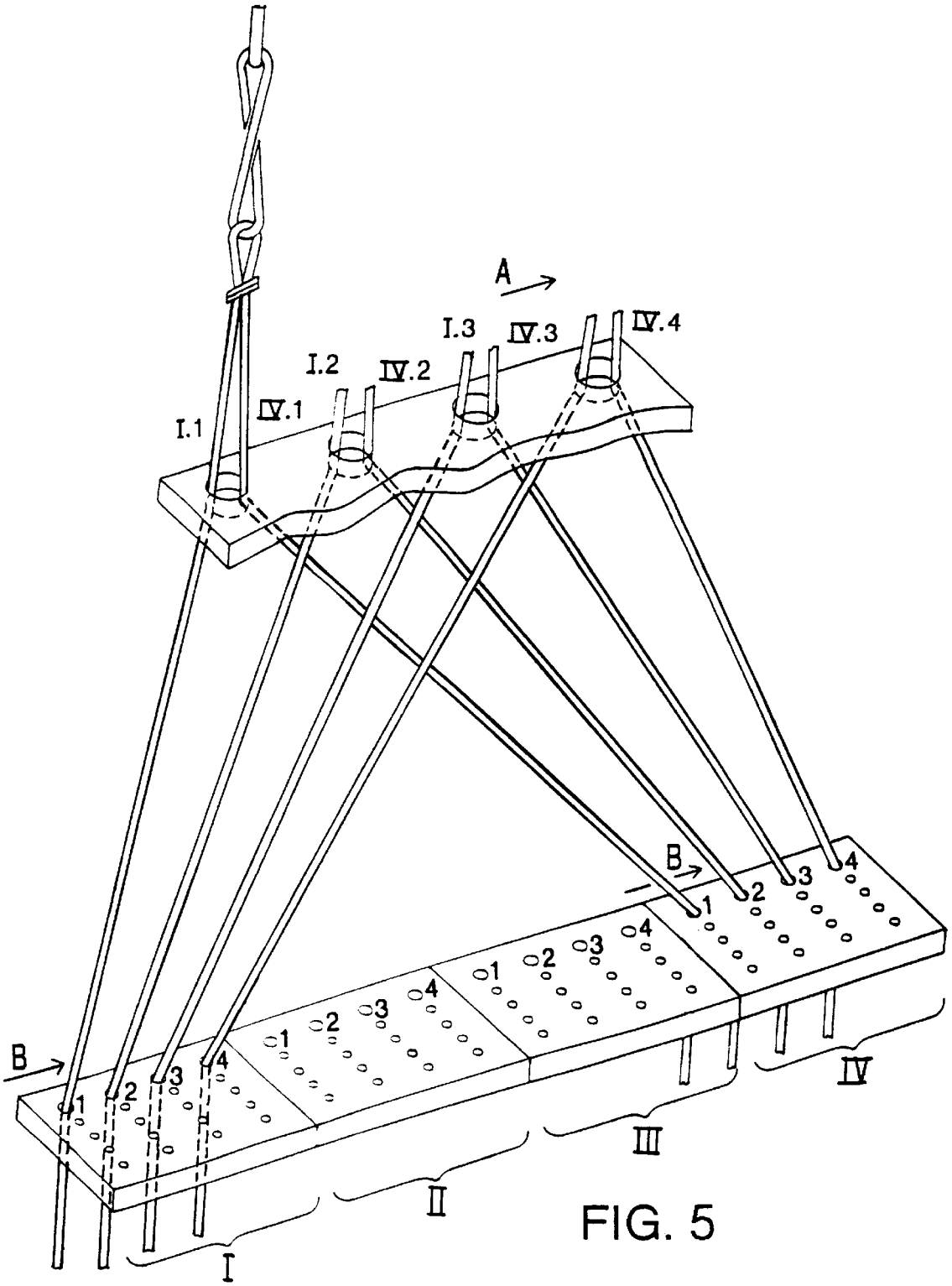
Figure 6:
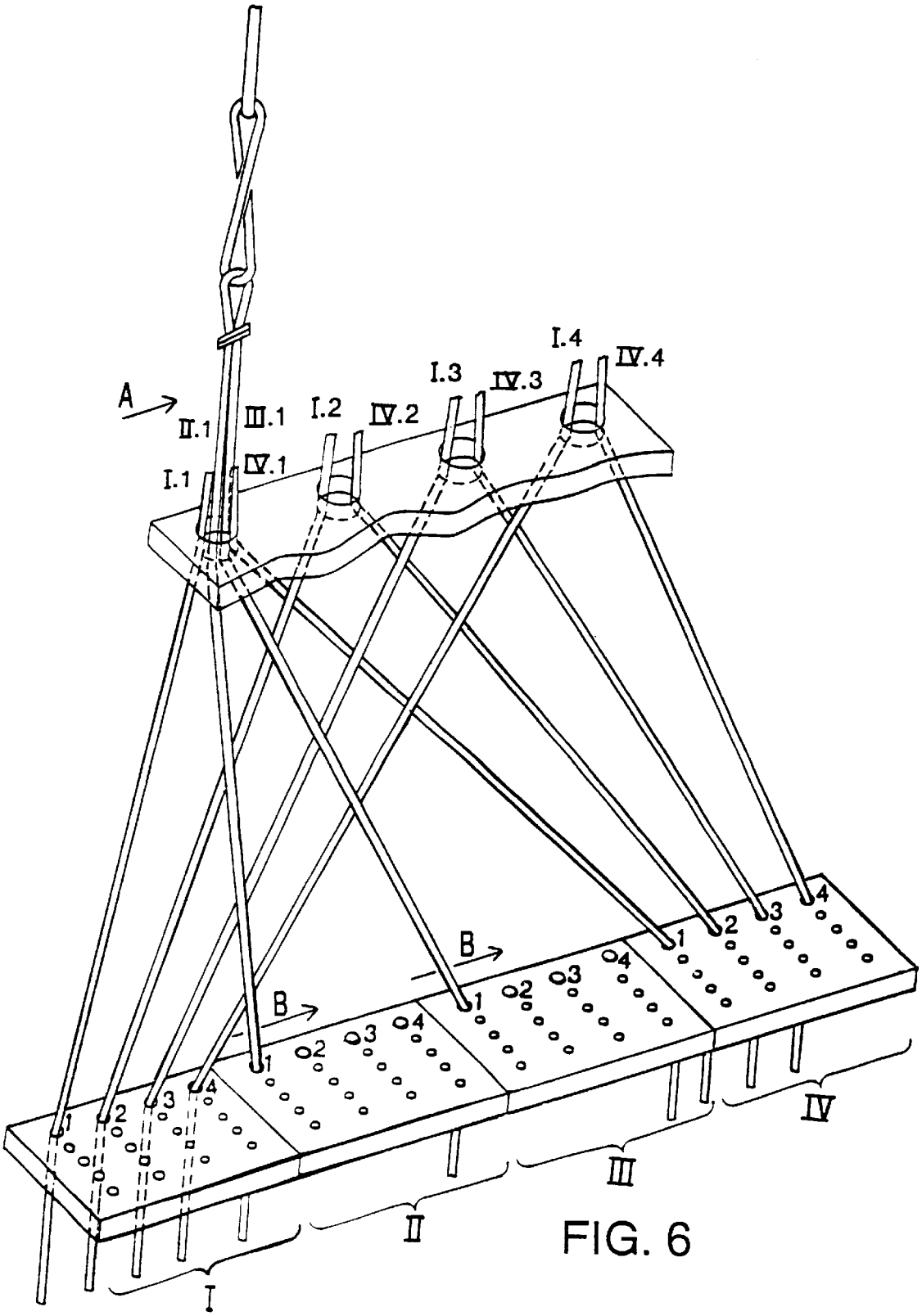
Figure 7:
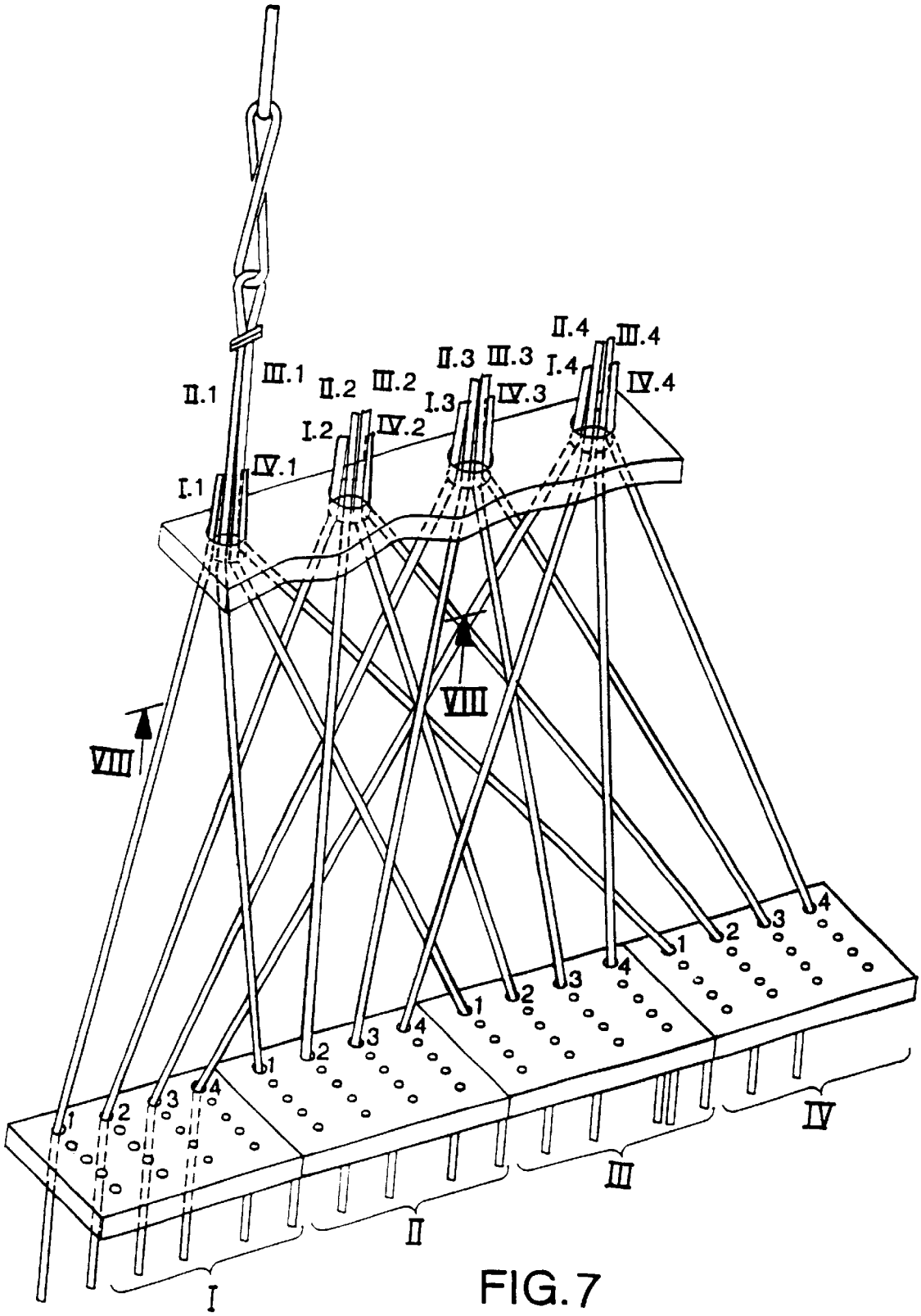

FIG. 5 shows the loom harness, in which the sections I.1 to I.4 and IV.1 to IV.4 of the double cord are arranged in the outwardly lying pattern repetitions I and IV in the lower harness board 5. This arrangement is obtained in that in the upper hardness board 3 the double cords are successively arranged in a sequence in the direction of the arrow A starting from left to right. Through this arrangement the sections which are arranged afterwards lie in each case in front of the previously arranged sections. As can be seen from FIG. 6 the sections II.1 and III.1 of the double cord are arranged in the same sense for the inwardly lying pattern repetitions II and III. FIG. 7 shows the loom harness, in which the sections in the rear row of the pattern repetitions I to IV are arranged in such a manner that a row of the arrangement of the harness cords in the upper harness board 3 are mapped in the identical sequence into the harness pattern repetitions in the lower harness board 5 in the direction of the arrow A.

Figure 2:
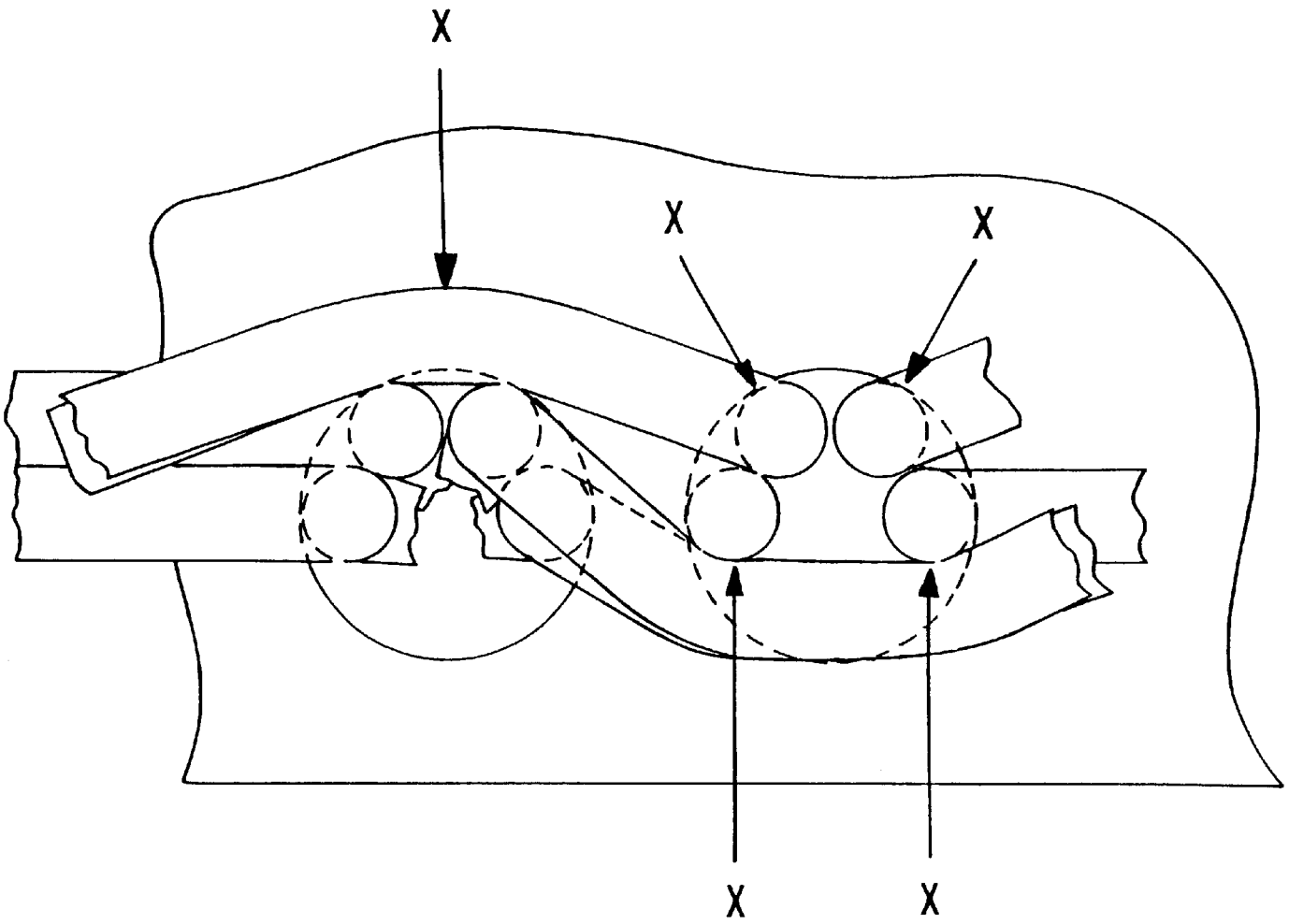
PRIOR ART FIG. 2
FIG. 2 a view, directed toward the lower side of the upper harness board, of the embodiment in accordance with FIG. 1, from which the path of the harness cords can be seen, FIG. 3 a view of the connection of a Jacquard device and an embodiment of a loom harness in accordance with invention, FIG. 4 an embodiment of a loom harness in accordance with the invention with four weaving repetition patterns and two harness cords which are arrange in the hindmost row, FIG. 5 the embodiment of the loom harness in accordance with FIG. 4 with eight harness cords arranged, FIG. 6 the embodiment of the loom harness in accordance with FIG. 4 with ten harness cords arranged, FIG. 7 the embodiment of the loom harness in accordance with FIG. 4 in which the harness cords of a row in the upper harness board are arranged in all pattern repetitions of the lower harness board, FIG. 8 a section along the line IIV—IIV in FIG. 7 and FIG. 9 the embodiment of a loom harness in accordance with FIG. 3 in which the harness cords are arranged in the hindmost row of all pattern repetitions and in the outwardly lying pattern repetitions of the second row.
Figure 8:
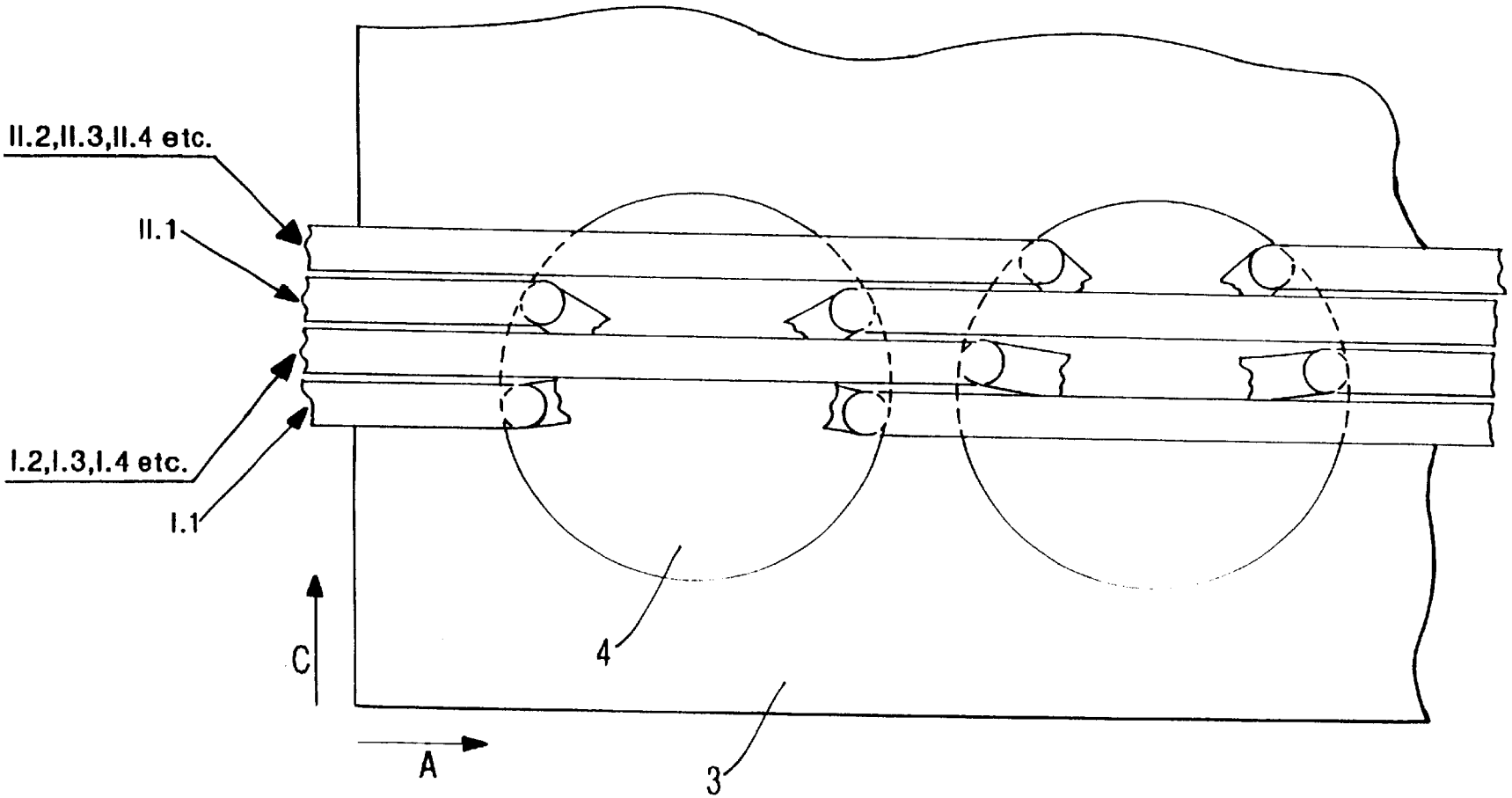

FIG. 8 shows a view corresponding to FIG. 2 of the path of the sections of the double cord in the above described embodiment of the loom harness. Through the successive arrangement the sections I.1 to I.4, II.1 to II.4, III.1 to III.4 and IV.1 to IV.4 of the double cord are arranged in a staggered manner so that the sections which are guided in a bore in the upper harness board cross at least one of the sections which are guided through the adjacent passage hole 4 in the upper harness board 3. The staggered arrangement has the effect that the named disadvantages of the know loom harness are eliminated and has the advantage that the sections are mutually guided.

Figure 9:
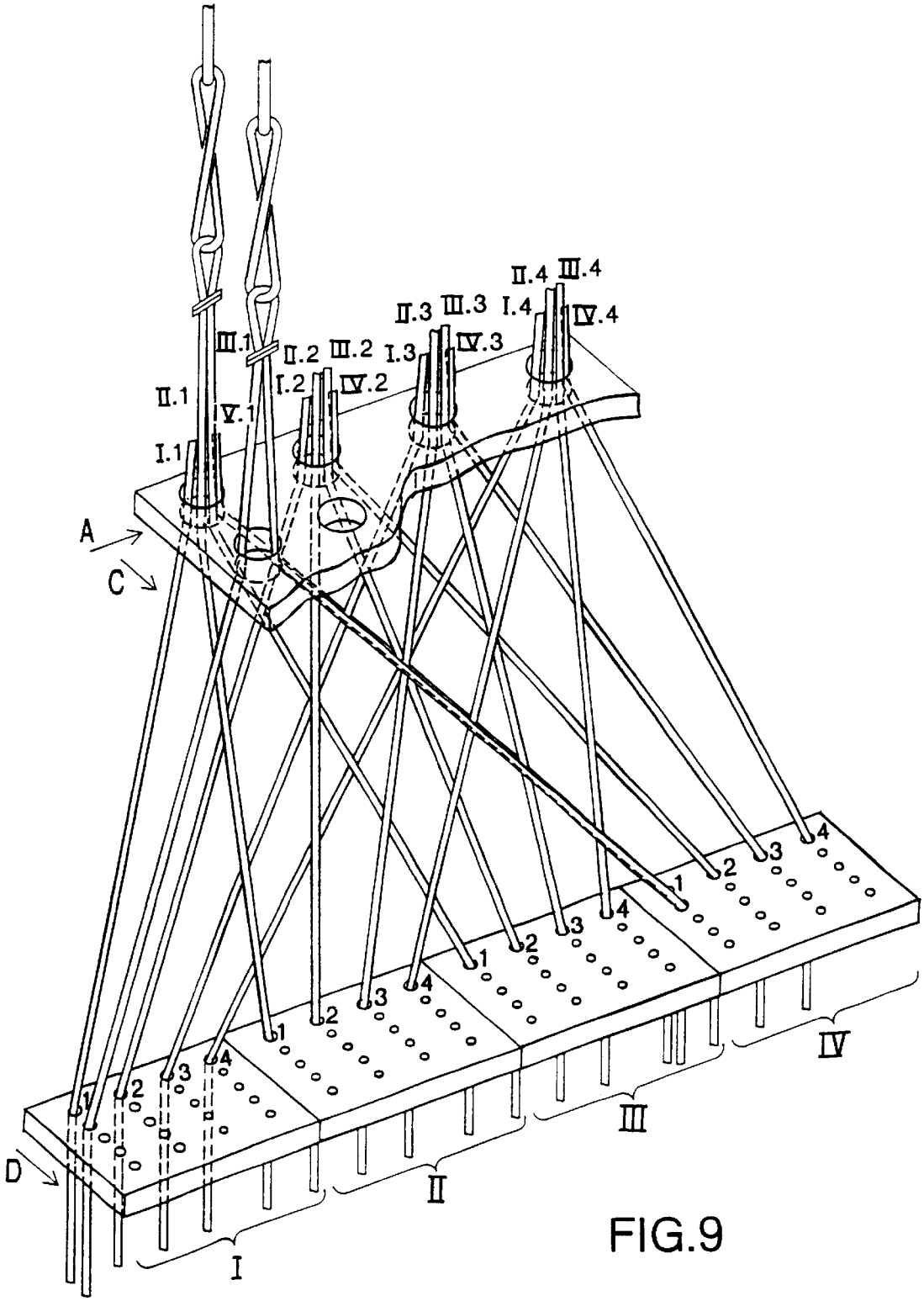

FIG. 9 shows the loom harness in which the harness pattern repetitions of the rear row and a harness cord of the row lying in front of it are arranged.

What is claimed is:

1. A loom harness, comprising an upper harness board having first passage holes arranged in a grid; a lower harness board having second passage holes arranged in a grid; a plurality of harness cords jointly guided for each pattern repetition in the first passage holes of the upper harness board and individually guided in the second passage holes of the lower harness board; a plurality of snap hooks for connecting the harness cords to a Jacquard device; and a plurality of return motion elements and heddles connected with the harness cords, respectively, wherein a row of an arrangement of the harness cords in the upper harness board is mapped, in a weft direction, in an identical sequence in harness pattern repetitions in the lower harness board;

wherein sections of the harness cords, which are guided in a passage hole in the upper harness board, are crossed by at least one cord of the harness cord sections guided through an adjacent passage hole in the upper harness board, and wherein the identical sequence of the arrangement of the harness cords in the upper harness board, is mapped, in the lower harness board, pattern-repetitionwise and in rows starting from respective outer pattern repetitions in a direction toward a center of the harness.

2. A loom harness, comprising an upper harness board having first passage holes arranged in a grid; a lower harness board having second passage holes arranged in a grid; a plurality of harness cords jointly guided for each pattern repetition in the first passage holes of the upper harness board and individually guided in the second passage holes of the lower harness board; a plurality of snap hooks for connecting the harness cords to a Jacquard device; and a plurality of return motion elements and heddles connected with the harness cords, respectively, wherein a row of an arrangement of the harness cords in the upper harness board is mapped in the weft direction in an identical sequence in harness pattern repetitions in the lower harness board;

wherein sections of the harness cords, which are guided in a passage are crossed by at least one cord of the harness cord sections guided through an adjacent passage hold in the upper harness board; and wherein the identical sequence of the arrangement of the harness cords in the upper harness board, in the lower harness board, is mapped pattern-repetitionwise and in rows starting from a center of the harness in a direction toward respective outer pattern repetitions.

3. A loom harness according to claim 1, wherein mapping in the lower harness board takes place pairwise per a passage hole in the upper harness board.

4. A loom harness according to claim 2, wherein the mapping in the lower harness board takes place pairwise per a passage hole in the upper harness board.

5. A loom harness, comprising an upper harness board having first passage holes arranged in a grid; a lower harness board having second passage holes arranged in a grid; a plurality of harness cords jointly guided for each pattern repetition in the first passage holes of the upper harness board and individually guided in the second passage holes of the lower harness board; a plurality of snap hooks for connecting the harness cords to Jacquard device; and a plurality of return motion elements and heddles connected with the harness cords, respectively, wherein a row of an arrangement of the harness cords in the upper harness board is mapped in a weft direction in an identical sequence in harness pattern repetitions in the lower harness board;

wherein sections of the harness cords, which are guided in a passage hole in the upper harness board, are crossed by at least one cord of the harness cord sections guided through an adjacent passage hole in the upper harness board, and wherein a snap hook is a single piece and has a middle section and two eye-shaped sections which lie with a free end in contact at the middle section of the snap hook and which are elastically deformable in order to be able to hang the snap hook into or out of a lifter and the harness cord into or out of the snap hook.

6. A loom harness, comprising an upper harness board having first passage holes arranged in a grid; a lower harness board having second passage holes arranged in a grid; a plurality of harness cords jointly guided for each pattern repetition in the first passage holes of the upper harness board and individually guided in the second passage holes of the lower harness board; a plurality of snap hooks for connecting the harness cords to Jacquard device; and a plurality of return motion elements and heddles connected with the harness cords, respectively, wherein a row of an arrangement of the harness cords in the upper harness board is mapped in the weft direction in an identical sequence in harness pattern repetitions in the lower harness board;

wherein the sections of the harness cords, which are guided in a passage hole in the upper harness board, are crossed by at least one cord of the harness cord sections guided through an adjacent passage hole in the upper harness board, and wherein the harness cord is a single piece provided with a loop at one end for hanging the harness cord into or out of the snap hook and having two sections for connecting the harness cord to the heddles.

7. A loom harness, comprising an upper harness board having first passage holes arranged in a grid; a lower harness board having second passage holes arranged in a grid; a plurality of harness cords jointly guided for each pattern repetition in the first passage holes of the upper harness board and individually guided in the second passage holes of the lower harness board; a plurality of snap hooks for connecting the harness cords to Jacquard device; and a plurality of return motion elements and heddles connected with the harness cords, respectively, wherein a row of an arrangement of the harness cords in the upper harness board is mapped in a weft direction in an identical sequence in harness pattern repetition in the lower harness board; and at least one section of the harness cords, which are guided in passage holes in the upper harness board, is located between harness cords which are guided through an adjacent passage hold in the upper harness board.

8. A loom, comprising a Jacquard device; and a harness connectable to the Jacquard device an including upper harness board having first passage holes arranged in a grid; a lower harness board having second passage holes arranged in a grid, a plurality of harness cords jointly guided for each pattern repetition in the first passage holes of the upper harness board and individually guided in the second passage holes of the lower harness board; a plurality of snap hooks for connecting the harness cords to the a Jacquard device; and a plurality of return motion elements and heddles connected with the harness cords, respectively, wherein a row of an arrangement of the harness cords in the upper harness board is mapped in a weft direction in an identical sequence in harness pattern repetition in the lower harness board; and at least one section of the harness cords, which are guided in passage holes in the upper harness board, is located between harness cords which are guided through an adjacent passage hold in the upper harness board.

* * * * *